United States Patent [19]

Sturm

[11] 4,216,867

[45] Aug. 12, 1980

[54] DISPLAY RACK HAVING STACKED DISPLAY TRAYS

[75] Inventor: Michael R. Sturm, Brookfield, Wis.

[73] Assignee: Display Corporation International, Milwaukee, Wis.

[21] Appl. No.: 931,863

[22] Filed: Aug. 7, 1978

[51] Int. Cl.[2] ..... A47F 5/02

[52] U.S. Cl. ..... 211/77; 211/131

[58] Field of Search ..... 211/77, 78, 71, 60 R, 211/131, 133, 163; D6/23, 24, 188

[56] References Cited

U.S. PATENT DOCUMENTS

| | | | |
|---|---|---|---|
| 1,755,477 | 4/1930 | Hunyady | 211/131 |
| 2,359,182 | 9/1944 | Wilsey | 211/77 X |
| 3,051,319 | 8/1962 | Glaser | 211/181 X |
| 3,499,540 | 3/1970 | Huncovsky | 211/60 R |
| 3,543,943 | 1/1970 | Joy et al. | 211/131 |
| 3,889,817 | 6/1975 | Berkman | 211/131 X |
| 4,030,608 | 6/1977 | Howard | 211/131 |
| 4,072,235 | 2/1978 | Munoz | 211/71 |

*Primary Examiner*—Roy D. Frazier
*Assistant Examiner*—Robert W. Gibson, Jr.
*Attorney, Agent, or Firm*—Michael, Best & Friedrich

[57] ABSTRACT

A display rack is provided which includes a vertical pole and a plurality of display trays, each of the display trays including a central aperture therethrough such that the display trays can be stacked in vertical relation on the vertical pole. The display trays each include an upper tray portion having a plurality of sets of container supporting surfaces for supporting cylindrical containers therein in an attractive and readily accessible arrangement. The display trays also include a lower tray portion providing spacing means for maintaining the display trays in vertically spaced apart relationship.

15 Claims, 4 Drawing Figures

40
102
108
100
97
108
40
96
98
104
94
95
106
68
50
64
46
84
49
32
54
45
47
52
51
84
44
71
69
66
72
48
54

50
70
68
46
84
49
54
54
64
45
47
52
71
51
32
84
44
66
54
48
69
72
70
14
12

DISPLAY RACK HAVING STACKED DISPLAY TRAYS

BACKGROUND OF THE INVENTION

The present invention relates to display racks, and more particularly to display racks of the type for use as point of purchase merchandising devices, and including means for supporting a plurality of cylindrical containers, such as cans of spray paint and the like, in a readily accessible and attractive manner.

SUMMARY OF THE INVENTION

The invention provides a display rack including a vertical pole and a plurality of display trays supported in vertically stacked relation on the vertical pole, each of the display trays intended to support a plurality of cylindrical containers. At least one of the display trays includes an upper tray portion for supporting the cylindrical containers in upwardly inclined relationship, the upper tray portion including a first central aperture for housing the vertical pole, and an upper surface including a plurality of upwardly sloping container supporting surfaces. The display trays also include a lower tray portion including means for supporting the upper tray portion in vertically spaced relationship above an adjacent display tray.

One of the principal features of the invention is the provision in the lower tray portion of a planar peripheral portion supporting the upper tray portion and a spacing portion centrally located with respect to the planar peripheral portion and extending downwardly therefrom, the spacing portion including a planar lower surface spaced downwardly from the planar peripheral portion and engageable against an upper surface of an adjacent display tray therebelow, and lower tray portion side walls joining the planar peripheral portion and the planar lower surface.

Another of the principal features of the invention is the provision of means for aligning two of the vertically stacked display trays in vertically aligned relationship, the aligning means including a projection extending from one of the display trays and a bore in another of the display trays, the projection positionable in the bore.

In one embodiment of the invention the upper tray portion is rectangular and includes a rectangular peripheral horizontal portion having an inner edge spaced outwardly from the vertical pole, and inwardly and upwardly sloping beveled sides, the beveled sides having a lower edge connected to the inner edge of the rectangular peripheral portion, and the beveled sides including concave, elongated upwardly sloping cavities for supporting cylindrical containers in upwardly and inwardly sloping relationship.

Other features and advantages of the present invention will become apparent to those skilled in the art upon reviewing the following detailed description, the drawings and the appended claims.

Figure 1:
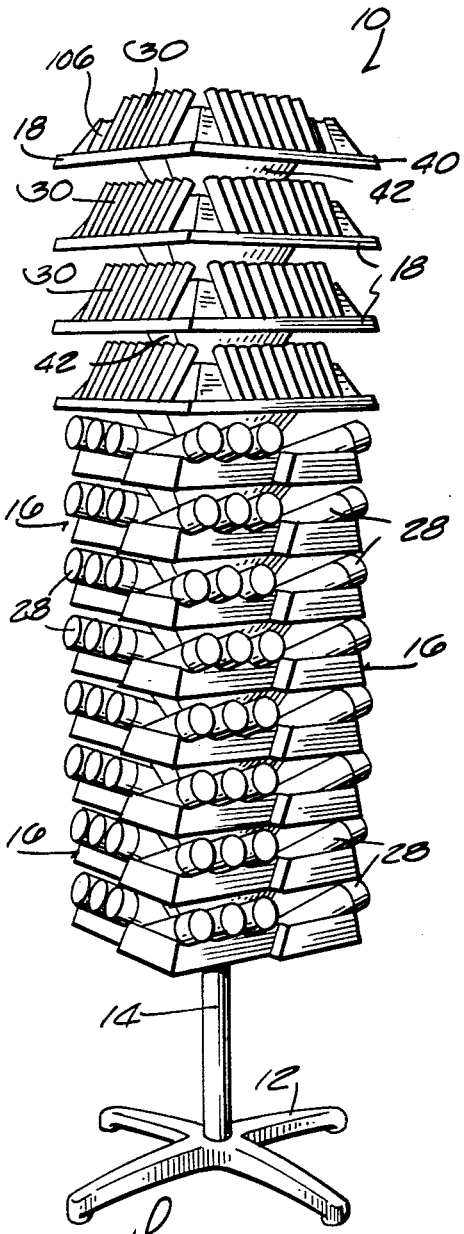
FIG. 1 is a perspective view of a display rack embodying the present invention.

Before describing one embodiment of the invention in detail, it is to be understood that the invention is not limited in its application to the details of construction and the arrangement of the components set forth in the following description or illustrated in the drawings. The invention is capable of other embodiments and of being practiced and carried out in various ways. Also, it is to be understood that the phraseology and terminology employed herein is for the purpose of description, and should not be regarded as limiting.

DESCRIPTION OF THE PREFERRED EMBODIMENT

Figure 3:
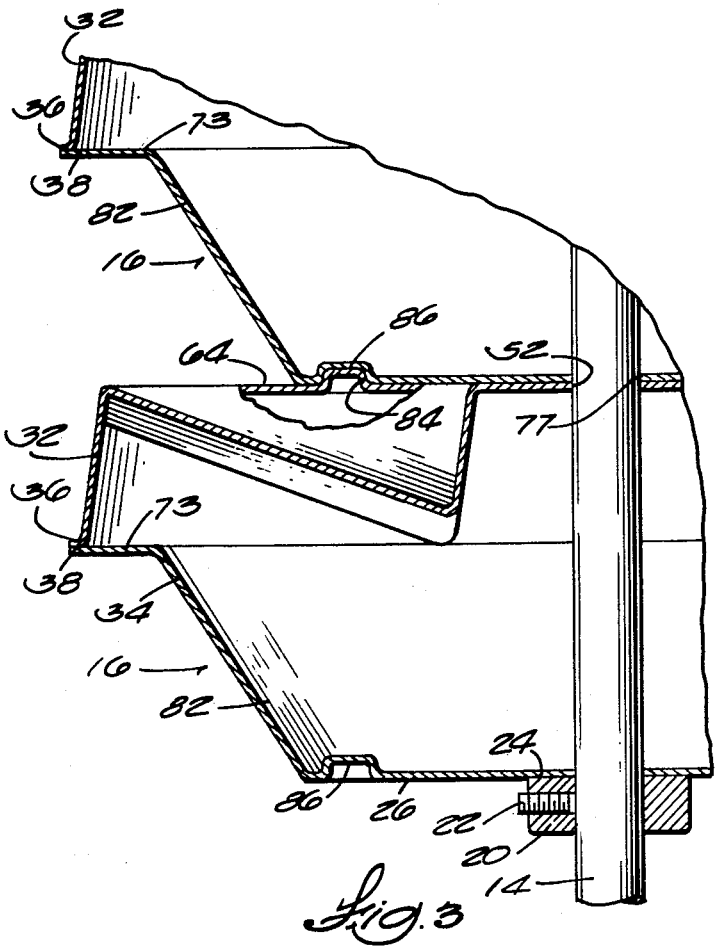
FIG. 3 is an enlarged cross-section elevation view of a portion of the display rack shown in FIG. 1.

A display rack 10 embodying the present invention is shown in FIG. 1 and generally includes a base 12 supporting an upwardly extending vertical pole 14. The vertical pole 14 in turn supports a plurality of vertically stacked display trays 16 and 18. The lowest display tray 16 of the stacked trays is shown in FIG. 3 as being supported by an annular collar 20 secured to the vertical pole 14 by a set screw 22, the upper surface 24 of the collar 20 supporting the lower surface 26 of the display tray 16.

The display trays 16 and 18 each include a central aperture therethrough intended to receive the vertical pole 14 such that the display trays can be assembled in stacked relation on the vertical pole 14. The display trays 16 and 18 are each supported thereon for rotation around the vertical pole to permit selection and removal of merchandise supported by the display rack 10.

The display trays 16 and 18 are generally intended to provide a means for supporting a plurality of merchandise items is an attractive manner and such that the items are readily accessible to a consumer. For example, in the illustrated construction, the trays 16 and 18 are used to support a plurality of cylindrical spray paint cans 28 and 30, respectively, in a readily accessible and attractive manner. The spray paint cans 28 are supported on the display tray 16 such that the color indicative caps of the paint cans 28 project outwardly so that a consumer can readily locate the can containing the desired paint color. The cans 28 are also readily removable from the display trays 16.

The display trays 16 are comprised of an upper tray portion 32 and a lower tray support portion 34 in vertically stacked relationship. While other arrangements can be provided, in the illustrated construction, the upper tray portion 32 and the tray supporting portion 34 are each constructed by vacuum forming sheet thermoplastic material to achieve the desired surface configurations and their peripheral edges 36 and 38, respectively, are heat sealed or otherwise bonded together to form lightweight, hollow display trays 16.

The display trays 18 are similarly comprised of an upper tray portion 40 and a lower tray portion 42 constructed by vacuum forming sheet material to achieve the desired surface configuration and bonding the peripheral edges of the upper and lower tray portions together. One of the advantages of the display rack of the invention is that the lower tray portions 34 and 42, respectively, of the display trays 16 and 18 are identical. Accordingly, the lower tray portions can be used in construction of both the display trays 16 and 18.

Figure 4:
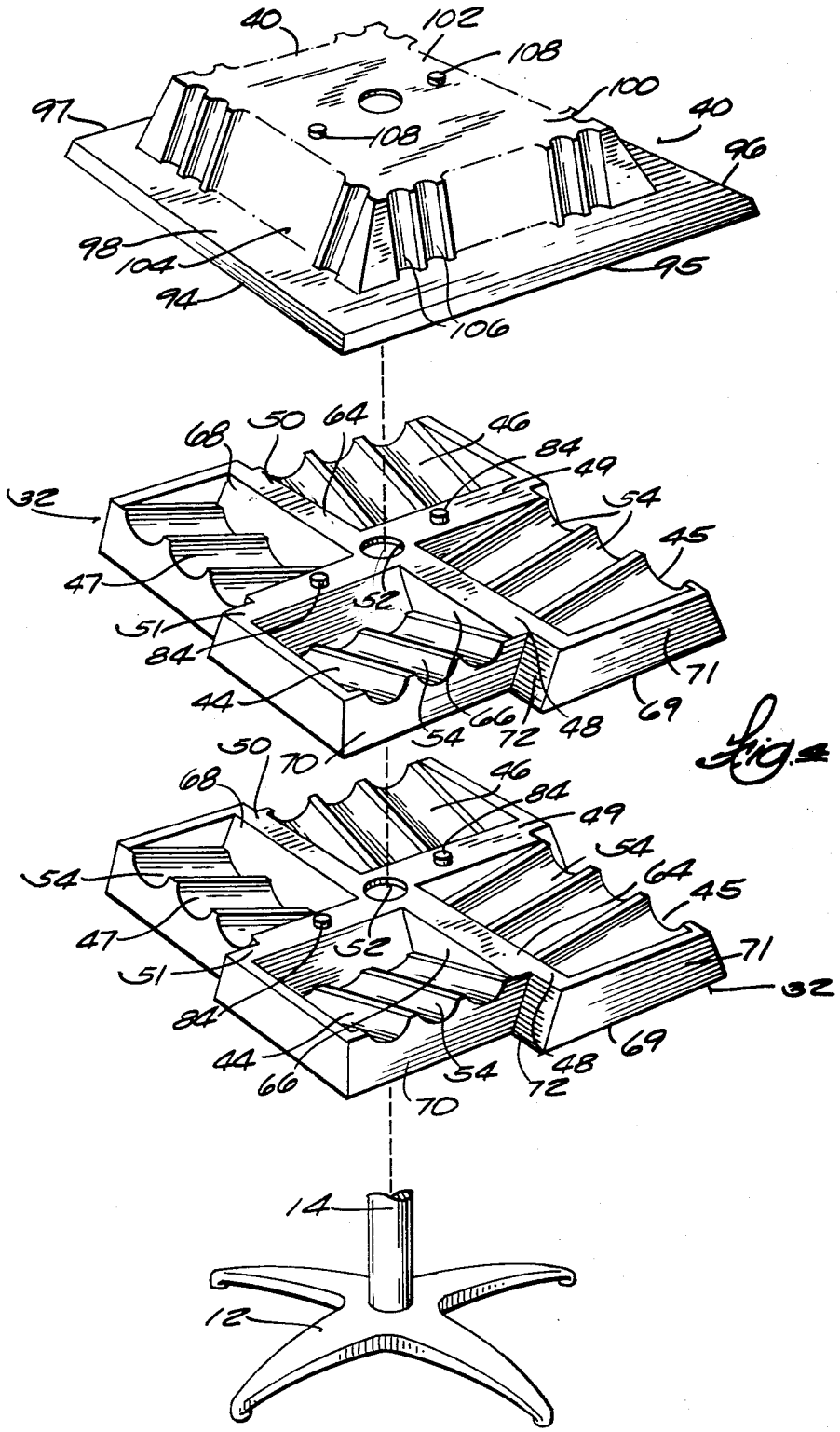
FIG. 4 is an enlarged exploded perspective view of a plurality of the display trays of the display rack shown in FIG. 1.

The upper tray portions 32 of the display trays 16 have a surface configuration which includes four sets of container supporting surfaces 44,45, 46 and 47, best shown in FIG. 4. Each set of the container supporting surfaces 44–47 is intended to support a plurality of cylindrical containers 28 in mutually parallel relationship and in an upwardly and outwardly inclined position. The sets of container supporting surfaces 44–47 are disposed peripherally around a central aperture 52 in the upper tray portion 32 and form four corner portions of the display tray 16. The sets of container supporting surfaces 44–47 are each identical and each include three concave or semi-cylindrical parallel elongated upwardly and outwardly extending container supporting troughs or grooves 54. The sets of container supporting surfaces 44–47 are respectively separated by radially extending linear members 48–51 which project outwardly from the aperture 52 and which each have a planar horizontal upper surface 64 for supporting an adjacent display tray 16 or 18 in stacked relation thereon. The radially extending linear members 48–51 each have one side 65 extending parallel to the container supporting grooves 54 of one of the sets of container supporting surfaces 44–47 and another side 68 forming a rear wall of another container supporting set.

As shown in FIG. 4, the upper portions 32 of the display tray 16 are each generally rectangular having sides 69. The sides 69 are non-linear and are comprised of a pair of side portions 70 and 71 which are joined by a transverse portion 72 generally intermediate the opposite ends of the sides 69.

Figure 2:
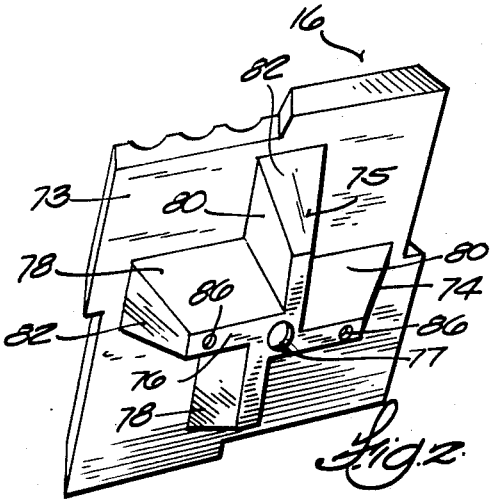
FIG. 2 is an enlarged perspective view of the lower tray portion of one of the display trays of the display rack shown in FIG. 1.

The lower tray portion 34 of tray 16 is best shown in FIGS. 2 and 3 and provides a means for supporting the upper tray portion 32 in vertically spaced relation above the upper tray portion 32 of a display tray 16 therebelow. The lower tray portion 34 includes an upper planar peripheral portion 73 joined to the periphery of the upper tray portion 32 to provide support for the upper tray portion. The lower tray portion 34 also includes a downwardly extending spacer portion 74 having a planar bottom surface 76. The spacer portion 74 provides a means for maintaining the upper tray portion 32 of adjacent respective display trays 16 and 18 in vertically spaced apart relation such that the cylindrical containers 28 can be conveniently supported therebetween and such that the cylindrical cans 28 can be readily placed on the display tray 16 or removed from the display trays. The spacer portion 74 is defined by a plurality of linear downwardly extending support members 75. The linear support members 75 each include narrow planar linear bottom surfaces 76 extending outwardly from a central aperture 77 in the lower tray portion 34 and toward one of the peripheral edges of the lower tray portion. The planar linear surfaces 76 are respectively joined to the planar peripheral portion 73 by upwardly and outwardly sloping side walls 78, 80 and 82.

Means are further provided to maintain accurate vertical alignment of the display trays 16, this means including projections 84 extending upwardly from the planar upper surfaces 64 of the outwardly extending linear members 48–51 of the upper tray portion 32. When the display trays 16 are positioned in stacked relation, the linear planar members 76 of the lower tray portion 34 are intended to be aligned with and positioned on the planar upper surfaces 64 of the upper tray portion 32. The lower tray portions 34 are provided with indentations or bores 86 in the linear planar surfaces 76 to receive the projections 84 as shown in FIG. 3 to provide for alignment of the display trays 16.

Referring to FIGS. 1 and 4, upper tray portion 40 of the display trays 18 is generally square and has four identical sides 94, 95, 96 and 97. The upper tray portion 40 is also generally defined by a horizontal peripheral edge 98 and a square central raised portion 100 having a central horizontal upper surface 102. The horizontal peripheral edge 98 and the central upper surface 102 are joined by upwardly and inwardly sloping walls 104, the walls 104 each having a lower edge integrally joined to the peripheral edge 98 and the upper edge joined to the central upper surface 102. The upwardly and inwardly sloping walls 104 are each provided with a plurality of parallel elongated concave container receiving grooves 106 extending from the lower edge to the upper edge. As shown in FIG. 1, each of the grooves 106 is intended to receive one of the cylindrical merchandise items 30 in a readily accessible manner.

To provide for vertical alignment of the display trays 18, the upper planar surfaces 100 of the display trays 18 include a pair of upwardly extending projections 108 positioned to be received within complementary recesses 86 in the lower tray portions. The upwardly extending projections 108 are positioned such that stacked display trays 18 can be mutually aligned. It will also be recognized by those skilled in the art that the display trays 16 and 18 can be stacked in any desired arrangement since the display trays can be interchangeably positioned.

I claim:

1. A display rack including:

a vertical pole, a plurality of separable display trays supported in vertically stacked relation on said vertical pole and for supporting a plurality of cylindrical containers, at least one of said display trays including, an upper tray member and a lower tray member fixedly secured together and defining a hollow cavity therebetween, said upper tray member including means for supporting the cylindrical containers in upwardly inclined relationship, said upper tray portion including a first central aperture for housing said vertical pole and an upper surface including a plurality of upwardly sloping cylindrical container supporting surfaces, and said lower tray member including means for supporting said upper tray portion in vertically spaced relation above an adjacent display tray.

2. A display rack as set forth in claim 1 wherein said container supporting surfaces each include a plurality of sets of elongated generally parallel concave surfaces sloping upwardly and outwardly, and wherein said sets of concave surfaces are located peripherally around said aperture and said parallel concave surfaces of one of said sets are transverse to said parallel concave surfaces of an adjacent one of said sets.

3. A display rack as set forth in claim 2 wherein said sets of container supporting surfaces are separated by linear separating members extending outwardly from said central aperture, said linear separating members having planar upper surfaces.

4. A display rack as set forth in claim 1 wherein said upper tray member includes nonlinear peripheral edges, said edges including a first linear edge portion, a second linear edge portion, and a transverse edge portion joining said first and second edge portions, said first edge portion forming a peripheral portion of one of said container supporting surfaces and said second edge portion forming a peripheral portion of another of said container supporting surfaces.

5. A display rack as set forth in claim 1 and further including means for aligning two of said vertically stacked display trays in vertically aligned relationship, said aligning means including a projection extending from one of said display trays and a bore in another of said display trays, said projection positioned in said bore.

6. A display rack as set forth in claim 1 wherein at least one of said display trays includes an upper tray portion including a rectangular peripheral horizontal portion having an inner edge, and inwardly and upwardly sloping beveled sides, said beveled sides having a lower edge connected to said inner edge, and said beveled sides including concave elongated upwardly sloping cavities for supporting cylindrical containers in upwardly and inwardly sloping relationship.

7. A display rack including a vertical pole, and a plurality of display trays supported in vertically stacked relation on said vertical pole and for supporting a plurality of cylindrical containers, at least one of said display trays including an upper tray member for supporting the cylindrical containers in upwardly inclined relationship, said upper tray member including a first central aperture for housing said vertical pole, and an upper surface including a plurality of sets of upwardly and outwardly sloping elongated generally parallel concave container supporting surfaces, said sets of container supporting surfaces being located peripherally around said aperture and said parallel concave container supporting surfaces of one of said sets being transverse to said container supporting surfaces on an adjacent one of said sets, and a lower tray member for supporting said upper tray member in vertically spaced relation above an adjacent display tray, said upper and lower tray members being fixedly secured together and defining a hollow chamber therebetween.

8. The display rack set forth in claim 7 wherein at least one of said display trays includes a rectangular upper tray portion having a peripheral horizontal portion including an inner edge, and inwardly and upwardly sloping beveled sides, said beveled sides having a lower edge connected to said inner edge, and said beveled sides including concave elongated upwardly sloping cavities for supporting cylindrical containers in upwardly and inwardly sloping relationship.

9. A display rack as set forth in claim 7 wherein said sets of container supporting surfaces are separated by linear separating members extending outwardly from said central aperture, said linear separating members having planar upper surfaces.

10. A display rack as set forth in claim 7 wherein said upper tray portion includes nonlinear peripheral edges, said edges including a first linear edge portion, a second linear edge portion, and a transverse edge portion joining said first and second edge portions, said first edge portion forming a peripheral portion of one of said sets, and said second edge portion forming a peripheral portion of another of said sets.

11. A display rack including a vertical pole, a plurality of display trays supported in vertically stacked relation on said vertical pole and for supporting a plurality of cylindrical containers, at least one of said display trays including an upper tray portion for supporting the cylindrical containers in upwardly inclined relationship, said upper tray portion including a first central aperture for housing said vertical pole and an upper surface including a plurality of upwardly sloping container supporting surfaces, and a lower tray portion including means for supporting said upper tray portion in vertically spaced relation above an adjacent display tray, said supporting means of said lower tray portion including a planar peripheral portion supporting said upper tray portion, and a spacing portion centrally located with respect to said planar peripheral portion and extending downwardly therefrom, said spacing portion including a planar lower surface spaced downwardly from said planar peripheral portion and engageable against an upper surface of an upper tray portion of an adjacent display tray therebelow, and downwardly and inwardly sloping walls joining said planar peripheral portion and said planar lower surfaces, said planar lower surfaces including a second central aperture therethrough for housing said vertical pole.

12. A display rack as set forth in claim 11 wherein said planar lower surface includes a plurality of narrow linear portions extending outwardly from said aperture.

13. A display rack including a vertical pole, a plurality of display trays supported in vertically stacked relation on said vertical pole and for supporting a plurality of cylindrical containers, at least one of said display trays including, an upper tray portion for supporting the cylindrical containers in upwardly inclined relationship, said upper tray portion including a first central aperture for housing said vertical pole and an upper surface including a plurality of upwardly sloping container supporting surfaces, said sets of container supporting surfaces being separated by linear separating members extending outwardly from said central aperture, said linear separating members having planar upper surfaces, and a lower tray portion including means for supporting said upper tray portion in vertically spaced relation above an adjacent display tray, said supporting means of said lower tray portion including a planar peripheral portion supporting said upper tray portion and a spacing portion centrally located with respect to said planar peripheral portion and extending downwardly therefrom, said spacing portion including a planar lower surface spaced downwardly from said planar peripheral portion and engageable against an upper surface of an upper tray portion of an adjacent display tray therebelow, and downwardly and inwardly sloping walls joining said planar peripheral portion and said planar lower surface, said planar lower surface including a second central aperture therethrough for housing said vertical pole, and wherein said planar lower surface includes a plurality of narrow linear portions extending outwardly from said aperture.

14. A display rack as set forth in claim 13 further including means for aligning two of said vertically stacked display trays in vertically aligned relationship, said aligning means including a projection extending from one of said narrow linear portions of said lower tray portion and said planar upper surfaces of said linear separating members, and a bore in the other of said narrow linear portions of said lower tray portion and said planar upper surfaces of said linear supporting members, said projection positionable in said bore.

15. A display rack including a vertical pole, and a plurality of display trays supported in vertically stacked relation on said vertical pole and for supporting a plurality of cylindrical containers, at least one of said display trays including an upper tray portion for supporting the cylindrical containers in upwardly inclined relationship, said upper tray portion including a first central aperture for housing said vertical pole, and an upper surface including a plurality of sets of upwardly and outwardly sloping elongated generally parallel concave container supporting surfaces, said sets of container supporting surfaces being located peripherally around said aperture and said parallel concave container supporting surfaces of one of said sets being transverse to said container supporting surfaces of an adjacent one of said sets, and a lower tray portion for supporting said upper tray portion in vertically spaced relation above an adjacent display tray, said lower tray portion including a planar peripheral portion supporting said upper tray portion, and a spacing portion centrally located with respect to said planar peripheral portion and extending downwardly therefrom, said spacing portion including a planar lower surface spaced downwardly from said planar peripheral portion and engageable against an upper surface of an upper tray portion of an adjacent display tray therebelow, and downwardly and inwardly sloping walls joining said planar peripheral portion and said planar lower surfaces, said planar lower surface including a second central aperture therethrough for housing said vertical pole.

* * * * *